United States Patent [19]

Waugh

[11] Patent Number: 4,973,882

[45] Date of Patent: Nov. 27, 1990

[54] TRANSFORMERLESS POWER CIRCUIT

[75] Inventor: Gerald F. Waugh, Orange, Conn.

[73] Assignee: Micro-Technology Licensing Corporation, Tequesta, Fla.

[21] Appl. No.: 397,109

[22] Filed: Aug. 22, 1989

[51] Int. Cl.[5] ..... H05B 41/14; G09G 3/10

[52] U.S. Cl. ..... 315/105; 315/169.4

[58] Field of Search ..... 315/97, 105, 169.1, 315/169.4, DIG. 1

[56] References Cited

U.S. PATENT DOCUMENTS

| | | | |
|---|---|---|---|
| 3,553,525 | 1/1971 | McGuirk, Jr. | 315/95 |
| 4,014,013 | 3/1977 | McElroy | 340/336 |
| 4,158,794 | 6/1979 | Sandler | 315/169.1 |
| 4,209,729 | 6/1980 | McElroy | 315/169.1 |
| 4,591,728 | 5/1986 | Kruger et al. | 307/75 |
| 4,719,389 | 1/1988 | Miesterfeld | 315/169.1 |

OTHER PUBLICATIONS

"LM556/LM556C Dual Timer", *National Semiconductor Corporation Linear Databook* 3; 1988 Edition; pp. 5-46 to 5-49.

*Primary Examiner*—David Mis
*Attorney, Agent, or Firm*—Felfe & Lynch

[57] ABSTRACT

A transformerless power circuit for heating a filament of a fluorescent display comprises integrated circuit timing means comprising two timers having output terminals for developing alternating output signals of opposite polarity with respect to a d.c. bias-component of each output signal. The circuit also includes external resistor means, condenser means and voltage supply means for controlling the frequency of the timers. The circuit also includes d.c. bias component resistor means coupled to the output terminals for developing biascomponents of the same polarity at the display filament terminals with respect to a common reference potential for connection to a fluorescent display filament.

6 Claims, 1 Drawing Sheet

TRANSFORMERLESS POWER CIRCUIT

This invention relates to a transformerless power circuit for heating a filament of a fluorescent display, and more particularly a vacuum fluorescent display.

Various direct drive display systems have previously been described such as in McGuirk, Jr. U.S. Pat. No. 3,553,525, McElroy U.S. Pat. No. 4,014,013, Sandler U.S. Pat. No. 4,158,794, McElroy U.S. Pat. No. 4,209,729, Kruger et al U.S. Pat. No. 4,591,728 and Miesterfeld U.S. Pat. No. 4,719,389. The apparatus of these prior patents are subject to various limitations and in general are more complex, physically larger, or require more complex and costly associated apparatus (e.g. associated microprocessor) than is desirable for some applications.

It is an object of the present invention, therefore, to provide a new and improved transformerless power circuit for heating a filament of a fluorescent display.

It is another object of the invention to provide a new and improved transformerless power circuit for heating a filament of a fluorescent display suitable for use in cooking apparatus.

It is another object of the invention to provide a transformerless power circuit for heating a filament of a fluorescent display which circuit is miniaturized.

It is another object of the invention to provide a new and improved transformerless power circuit for heating a filament of a fluorescent display which operates at a high frequency of, for example, 5 to 10 kilohertz for the repetitive alternation of current through the cathode filament of the display elements.

It is another object of the invention to provide a new and improved transformerless power circuit for heating a filament of a vacuum fluorescent display in which the filament is reverse biased with respect to the grid of the vacuum fluorescent display element when the display element is off during both the maximum and minimum voltages at the filament.

It is another object of the invention to provide a new and improved transformerless power circuit for heating a filament of a vacuum fluorescent display in which the refresh frequency for the grid and associated anodes can be at a minimal value without beat frequency problems associated with line frequency (50/60 Hz) filament power.

In accordance with the invention, a transformerless power circuit for heating filament of a fluorescent display comprises integrated circuit timing means comprising two timers having output terminals for developing alternating output signals of opposite polarity with respect to a d.c. bias-component of each output signal. The circuit also includes external resistor means, condenser means and voltage supply means for controlling the frequency of the timers. The circuit also includes d.c. bias-component resistor means coupled to the output terminals for developing bias-components of the same polarity at the display filament terminals with respect to a common reference potential for connection to a fluorescent display filament.

For a better understanding of the invention, together with other and further objects thereof, reference will be made to the following description, taken in connection with the accompanying drawings, and its scope will be pointed out in the appended claims.

Referring now to the drawing.

Figure 1:
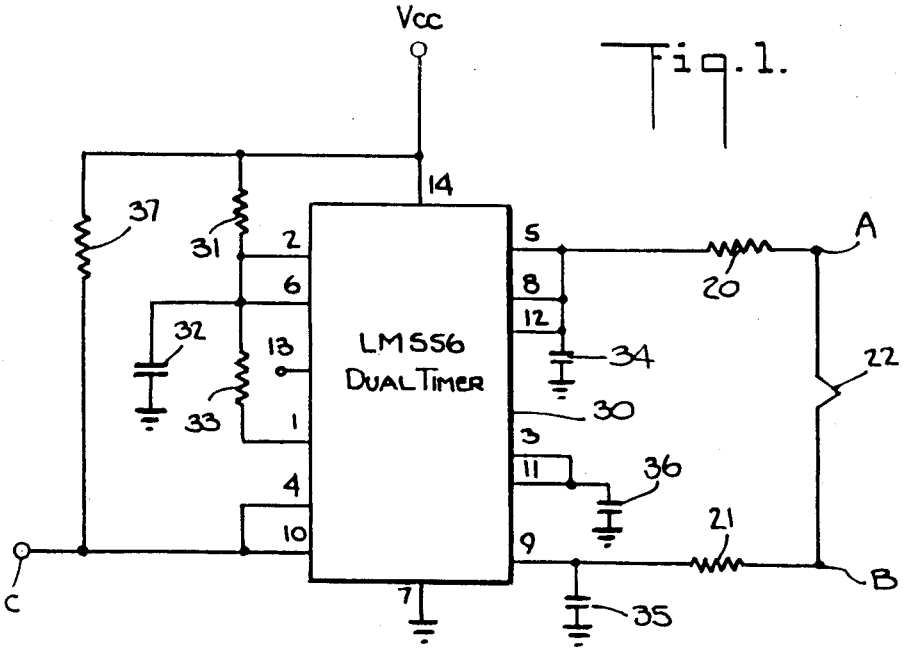
FIG. 1 is a circuit diagram, partly schematic, of a transformerless power circuit for heating a filament of a fluorescent display in accordance with the invention.

Referring now more particularly to FIG. 1 of the drawings, a transformerless power circuit for heating a filament of a fluorescent display comprises integrated circuit timing means comprising two timers having output terminals for developing alternating output signals of opposite polarity with respect to a d.c. bias-component of each output signal. The integrated circuit timing means preferably comprises a National Semiconductor Corporation LM 556 Dual Timer. This Dual Timer and its operating characteristics ar described in detail in National Semiconductor Corporation Linear DataBook 3, 1988 Edition, at pages 5-46 to 5-49, inclusive. In FIG. 1 the LM 556 Dual Timer 30 has pins 1–14 corresponding to the pins of the timer as represented in the catalog. The two timers of the dual timer operate synchronously with each other sharing $V_{cc}$ and ground. Each timer includes a flip-flop and two comparators. Pins 1–6 are associated with one timer. Pin 7 is ground and pin 14 is $V_{cc}$ and are shared by both timers. Pins 8–13 are associated with the other timer. Pins 1 and 13 are discharge, pins 2 and 12 are threshold, pins 3 and 11 are control voltage, pins 4 and 10 are reset, pins 5 and 9 are output, and pins 6 and 8 are trigger pins.

The transformerless power circuit also includes external resistor means, condenser means and voltage supply means for controlling the frequency of the timers. The external resistor means comprises resistor 31 and the condenser means comprises condenser 32 and the voltage supply means comprises the source $V_{cc}$ and ground. The resistor 33 provides a symmetrical signal at the outputs.

The condensers 34 and 35 are spike-suppressing condensers and the output terminals of the timers are connected to the spike-suppressing condensers.

The pin 13 is not used. The condenser 36 is for the purpose of stabilizing the internally generated comparator control voltage.

A transformerless power circuit typically also includes a filament of a vacuum fluorescent display and the output terminals of the Dual Timer are coupled to the filament.

The integrated circuit timing means 30 comprises two timers having input terminals 2, 6 and 8, 12 with an output terminal 5 of one timer coupled to an input terminal 12 of a second timer for synchronization and with the input terminals 2, 6 of the one timer coupled to the external resistor means 31, condenser means 32 and voltage supply means $V_{cc}$.

The d.c. bias-component resistor means preferably comprises two resistors 20, 21, one resistor 20 being coupled in series between an output terminal 5 of one timer and the filament 22 and another resistor 21 being coupled in series between an output terminal 9 of a second timer and the filament 22.

The resistor 33 is utilized for symmetry, that is, to make the output signal of rectangular wave shape so that one side of the wave is not less than the other. The condenser 32 discharges through the resistor 33 so that the timer switches at an even rate. The control voltage terminals 3 and 11 set the bias on the timer comparators and as represented in FIG. 1, an external bias may not be necessary. The reset pins 4 and 10 shut the dual timing circuit down and turn it on. The reset terminals 4 and 10 are pulled up to $V_{cc}$ by resistor 37. A master control system may shutdown the filament drive current by pulling terminal "C" low.

Figure 2:
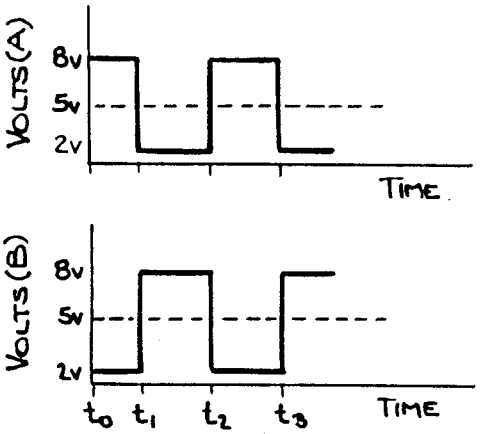
FIG. 2 is a graph representing output voltages at output terminals A and B of the FIG. 1 apparatus.
Figure 3:
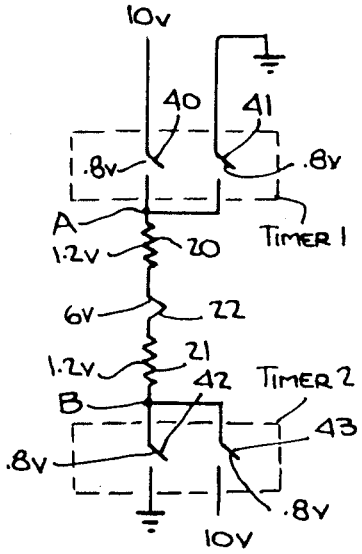
FIG. 3 is a circuit diagram, partly schematic, representing components of the FIG. 1 apparatus with typical voltage drops associated therewith.

Considering now the operation of the transformerless power circuit for heating a filament of a fluorescent display of FIG. 1, with reference to FIGS. 2 and 3, the voltage $V_{cc}$ may be, for example, 10 volts. The switches 40 and 41 of FIG. 3 represent schematically the internal switching of one timer and the switches 42 and 43 represent schematically the internal switching of the other timer.

When one timer is switched on, i.e., switches 40 closed and 41 open, the other timer is off, i.e. switches 42 closed and 43 open. There may be, for example, a 0.8 volt drop across the switch 40 and, for example, a 1.2 volt drop across resistor 20 with, for example, a 6 volt drop across filament 22 and, for example, a 1.2 volt drop across resistor 21 and, for example, a 0.8 volt drop across switch 42. Accordingly, as represented in FIG. 2 the voltage at terminal A is, for example, 8 volts during an initial period of time. The voltage at terminal B is, for example, 2 volts during the same initial period of time $t_o - t_1$.

At time $t_1$, as may be determined by the values of the resistor 31 and condenser 32, the dual timer circuit switches the condition of its two timers, i.e. the switches 40 open and 41 closed of FIG. 3 and the switches 42 open and 43 closed, applying the 10 volt supply $V_{cc}$ across switch 43 which causes, for example, a 0.8 volt drop. Resistor 21 which causes, for example, a 1.2 volt drop. Filament 22 causes, for example, a 6 volt drop. Resistor 20 causes, for example, a 1.2 volt drop and switch 41 causes, for example, a 0.8 volt drop. Between times $t_1$ and $t_2$ of FIG. 2, which represent one-half cycle of the waveform, the voltage at terminal A is, for example, 2 volts and the voltage at terminal B is, for example, 8 volts. At time $t_3$ as determined by the value of the resistor 31 and the condenser 32, the timing circuits again switch state and between times $t_1$ and times $t_3$, a full cycle of the multiplex operation is represented.

As is apparent from FIG. 2, at each terminal A and B, a d.c. bias component of, for example, 5 volts exists. Thus, the filament 22 is biased at +5 volts with respect to the grid of the vacuum fluorescent display which is at 0 volts when the display is off because of the reverse bias. When the display is on, the grid is at a voltage of approximately, for example, 30 volts and, while the display is on, the grid is at all times positive with respect to the filament.

The vacuum fluorescent display grid may be switched by a circuit (not shown) at a lower frequency than the multiplexing frequency of the filament which may be in the range of, for example, 5–10 kilohertz.

When the grid is switched to a voltage of, for example, 0 volts to shut off the display, the filament has a d.c. bias component of +5 volts resulting in a minimum reverse bias of +2 volts during the multiplexing operation of the filament. Because of the reverse filament-grid bias, the display can be fully switched off with the grid voltage. Both ends of the filament are simultaneously switched in opposite polarities relative to the bias voltage.

The following parameters may be used, for example, in a circuit in accordance with the invention:

$V_{cc} = +10$ volts
resistor 31 = 20 kilohms
resistor 37 = 10 kilohms
condenser 32 = 0.001 microfarads
resistor 33 = 8.2 kilohms
condenser 34 = 0.1 microfarads
condenser 35 = 0.1 microfarads
condenser 36 = 0.01 microfarads The filament multiplex frequency may be, for example, between 5 to 10 kilohertz, and is limited only by the switching frequency of the LM 556 dual timer.

From the foregoing description it will be apparent that a circuit in accordance with the invention has several advantages. The circuit is capable of operating at a high multiplex frequency of 5–10 kilohertz and perhaps as high as 40 kilohertz. The circuit does not require a special transformer and is not a dedicated circuit for a particular fluorescent display. In order to adjust the frequency and voltage levels for any filament for a vacuum fluorescent display, it is only necessary to adjust the input voltage and the value of the external resistors and condensers. The circuit uses a minimum number of components and an integrated circuit which insures that the vacuum fluorescent display has a reverse bias on the filament-grid structure during the off period for the display so that the display is fully shut off as desired. Because of the high multiplex frequency there is no chance of a visual beat frequency between the relatively low grid switching frequency of, for example, 100 hertz and the filament multiplex frequency to eliminate adverse visual effects. Vacuum fluorescent displays may operate with negative voltages. In such cases one would apply, for example, negative 10 volts to all the ground terminals of the embodiment just described and ground to the $V_{cc}$ terminal.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A transformerless power circuit for heating a filament of a fluorescent display, said circuit comprising:

integrated circuit timing means comprising two timers having output terminals for developing alternating output signals of opposite polarity with respect to a d.c. bias-component of each output signal;

external resistor means, condenser means and voltage supply means for controlling the frequency of said timers; and d.c. bias-component resistor means coupled to said output terminals for developing d.c. bias components of the same polarity at said output terminals with respect to a common reference potential for connection to a fluorescent display filament.

2. A transformerless power circuit in accordance with claim 1, which includes a filament of a vacuum fluorescent display and in which said output terminals are coupled to said filament.

3. A transformerless power circuit in accordance with claim 1, in which said integrated circuit timing means comprises two timers having input terminals, with an output terminal of one timer coupled to the input terminal of the second timer and with the input terminals of said one timer coupled to said external resistor means, condenser means and voltage supply means.

4. A transformerless power circuit in accordance with claim 2, in which said d.c. bias-component resistor means comprises two resistors, one resistor coupled in series between an output terminal of one timer and said filament and another resistor coupled in series between an output terminal of the second timer and said filament.

5. A transformerless power circuit in accordance with claim 1, which includes spike-suppressing condensers in which said output terminals are coupled to said spike-suppressing condensers.

6. A transformerless power circuit in accordance with claim 1, which includes means for easily turning the filament current on and off.

* * * * *